US007011212B2

(12) United States Patent
Thomson

(10) Patent No.: US 7,011,212 B2
(45) Date of Patent: Mar. 14, 2006

(54) TOOL KITS

(75) Inventor: Chip E. Thomson, Austin, TX (US)

(73) Assignee: Beza, L.P., Austin, TX (US)

( * ) Notice: Subject to any disclaimer, the term of this patent is extended or adjusted under 35 U.S.C. 154(b) by 74 days.

(21) Appl. No.: 10/636,906

(22) Filed: Aug. 7, 2003

(65) Prior Publication Data

US 2004/0079661 A1 Apr. 29, 2004

Related U.S. Application Data

(60) Provisional application No. 60/401,719, filed on Aug. 7, 2002.

(51) Int. Cl.
*B65D 85/00* (2006.01)

(52) U.S. Cl. ..... 206/373; 206/349; 224/237; 224/240; 224/681; 224/904

(58) Field of Classification Search ..... 206/349, 206/373, 379, 759; 224/237, 240, 671, 672, 224/674, 680–684, 904
See application file for complete search history.

(56) References Cited

U.S. PATENT DOCUMENTS 2,758,798 A * 8/1956 Schmidt ..... 224/245
4,801,059 A * 1/1989 Hayes ..... 224/240
D323,744 S * 2/1992 Casale ..... D3/230
5,255,835 A * 10/1993 Burks ..... 224/666
5,337,933 A * 8/1994 Nunez ..... 224/581
5,395,023 A * 3/1995 Naymark et al. ..... 224/682
5,445,303 A * 8/1995 Cawile, Jr. ..... 224/222
5,562,238 A * 10/1996 White ..... 224/237
5,568,889 A * 10/1996 Holloway et al. ..... 224/661
5,779,122 A * 7/1998 Martinelli ..... 224/683
6,116,419 A * 9/2000 Campagna et al. ..... 206/373
6,244,486 B1 * 6/2001 Holland et al. ..... 224/584
6,446,852 B1 * 9/2002 Sorensen et al. ..... 224/661

OTHER PUBLICATIONS

Five color pages from historical copy of windzone.com website showing and describing certain tool kits as explained in the Declaration of Chip E. Thomson filed with this Information Disclosure Statement.
Five pages of annotated photographs of a tool kit as explained in the Declaration of Chip E. Thomson filed with this Information Disclosure Statement.
Four pages of annotated photographs of a tool kit as explained in the Declaration of Chip E. Thomson filed with this Information Disclosure Statement.
Thirteen color pages from historical copy of windzone.com website showing and describing certain tool kits as explained in the Declaration of Chip E. Thomson filed with this Information Disclosure Statement.
Seven color pages from historical copy of windzone.com website showing and describing certain tool kits as explained in the Declaration of Chip E. Thomson filed with this Information Disclosure Statement.

* cited by examiner

*Primary Examiner*—John A. Ricci
(74) *Attorney, Agent, or Firm*—Fulbright & Jaworski L.L.P.

(57) ABSTRACT

Tool kits that include an enclosure that may be made of fabric. In one version, the enclosure may include a multipurpose tool pocket; a bit pocket; an adapter strap; a utility pocket configured to include at least cable ties and wire; a front flap configured to overlap the multipurpose tool pocket and the bit pocket; and a top flap configured to overlap the front flap. A multipurpose tool having an adjustable wrench, pliers, a knife blade, a saw, a screwdriver, a file, a wire cutter and/or stripper, and a bit driver may be disposed within the multipurpose tool pocket.

49 Claims, 6 Drawing Sheets

TOOL KITS

CROSS-REFERENCE(S) TO RELATED APPLICATION(S)

This application claims priority to U.S. Provisional Patent Application Ser. No. 60/401,719, filed Aug. 7, 2002, the entire contents of which are expressly incorporated by reference.

BACKGROUND OF THE INVENTION

1. Field of the Invention

The invention relates to tool kits and the tools in those tool kits.

2. Description of Related Art

Existing tool kits that can be worn as a waistline accessory, such as the currently popular LEATHERMAN brand of tool kits and the like, include many useful tools. However, more tools than what are offered in such tool kits are often needed by individuals in different situations. Such a need can be addressed in some cases by carrying around a tool box, but the same are often heavy, clumsy to work with, take an effort to keep organized and stored, and may not be feasibly sized for transportation or storage when only small spaces are available.

Alternatively, tool belts exist that include an open pocket into which many different tools—like wrenches, screw drivers, tape measures, pliers, and the like—may be placed. The open pocket may be worn around the waist in a specially-designed tool belt that is so large that it can fit over an existing everyday belt. The specially-designed belt may even include features such as suspenders or other straps designed to offset the stress on one's waist. Nevertheless, traditional tool belts can be heavy, ill-fitting, and often uncomfortable. Moreover, they, too, are bulky, and not easily transported or stored in small spaces.

SUMMARY OF THE INVENTION

The present tool kits include tools adapted for a wide variety of uses, and may be worn in the same way that tool kits with far fewer tools such as the LEATHERMAN brand of tool kits are worn—e.g., attached to an everyday belt (as opposed to the type of belt specially designed for devices currently known as tool belts, although the present tool kits could be clipped to such specially-designed belts); worn in a pocket on an article of clothing such as a shirt, a jacket, a vest, a pair of pants, a pair of overalls, etc.; or carried in the palm of the hand, especially without the need for a handle as are needed with traditional tool boxes.

The present tool kits may include one or more multipurpose tools; adapters for tools contained within such multipurpose tools, such as bit drive adapters; bits for use in connection with one or more of the tools in one or more of the multipurpose tools, along with holders for such bits; and accessories such as bailing or mechanic's wire and/or cable ties. The present tool kits may be carried in a fabric enclosure that, when closed, helps protect the contents from the elements and keep them in place, and is easily portable as described above. The enclosure may be kept closed by being configured with multiple flaps that can be folded and secured to other parts of the enclosure with material such as VELCRO®brand hook and loop fastners. Further, the enclosure may contain open pockets within it that are configured for accepting and holding in place various multipurpose tools, adapters, bits, and/or bit holders. An example of one of the present tool kits is the DAY TRIPPER tool kit, sold by Windzone of Austin, Tex. and which soon may be sold by Beza of Austin, Tex.

BRIEF DESCRIPTION OF THE DRAWINGS

The following drawings demonstrate aspects of the present tool kits. The drawings illustrate by way of example and not limitation, and the dimensions and arrangement of the items noted in them are exemplary.

DESCRIPTION OF ILLUSTRATIVE EMBODIMENTS

Figure 1:
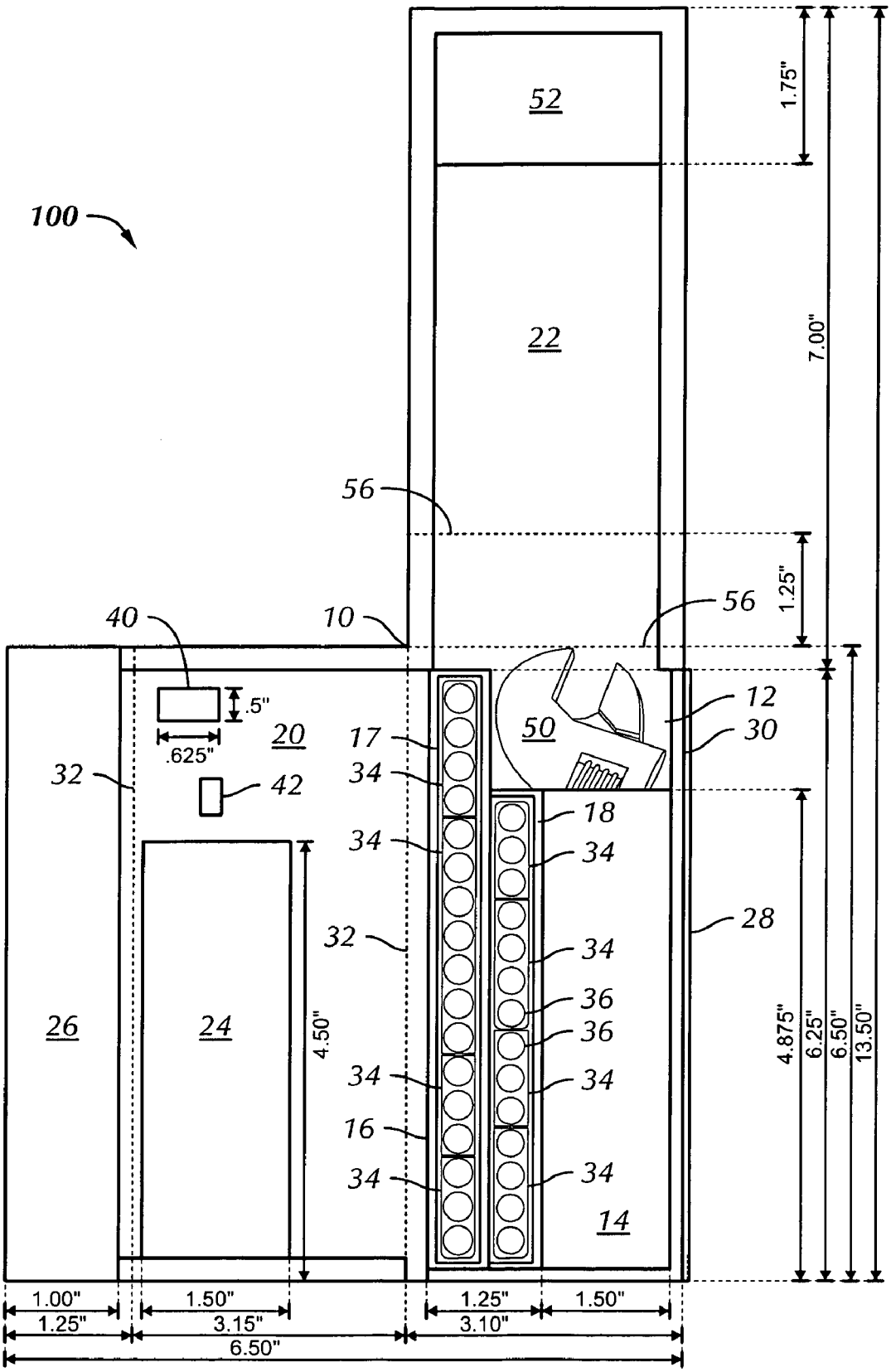
FIG. 1 is a view of the interior of one of the present tool kits. In this figure, the enclosure of the tool kit that is illustrated is open. The dashed lines represent lines along which portions of the enclosure may be folded in order to close the enclosure.

In this document (including the claims), the terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. For example, a tool kit that "comprises," "has," "contains," or "includes" one or more elements possesses at least those one or more elements, but is not limited to those one or more elements. This is also true of individual elements. Thus, a front flap that "has" an inner portion on which a portion of a hook and loop fastner system is disposed has at least such an inner portion, but also covers front flaps with such a portion and snaps.

The terms "a" and "an" are defined as one or more than one. The term "another" is defined as at least a second or more. The term approximately is defined as at least close to a given value or either end of a range (e.g., preferably within 10% of, more preferably within 1% of, and most preferably within 0.1% of).

Those of ordinary skill in the art will appreciate that in the detailed description below, certain well known components and assembly techniques have been omitted so that the present tool kits are not obscured in unnecessary detail.

While the present tool kits are adaptable and may be modified to include multipurpose tools containing other tools than those illustrated and described, or may contain a different assortment of bits, etc., the present tool kits are not intended to be limited to the particular forms disclosed—they are exemplary only. All modifications, equivalents, and alternatives falling within the scope of the disclosure as defined by the claims are intended to be covered.

One version of the present tool kits is illustrated in FIGS. 1–6. Tool kit 100 shown in FIG. 1 includes enclosure 10. Enclosure 10 has an inner surface 12 and an outer surface 30. The edges of enclosure 10 may have fabric "piping" along them, protecting them from wear. The inner and outer surfaces of enclosure 10 may surround backing or stiffening material that is paper-based (e.g., cardboard) or more preferably plastic. Enclosure 10 may have multipurpose tool pocket 14 attached to inner surface 12 and bordered by a portion of inner surface 12. Enclosure 10 may also-have bit pocket 16 attached to inner surface 12 and bordered by another portion of inner surface 12. Bit pocket 16 may include bit holder cells 17 and 18. Enclosure 10 may have front flap 20 and top flap 22. Enclosure 10, along with the flaps, pockets, and straps disclosed in this document, may be made from any suitable fabric, including fabrics made from polymers such as nylon.

Enclosure 10 may have utility pocket 24 attached to inner surface 12 and, more specifically, the portion of inner surface 12 disposed on front flap 20. A portion of a hook and loop fastner system 26 may be attached to an inner portion of front flap 20. A corresponding portion of the hook and loop fastner system 28, configured for mating with 26, may be attached to outer surface 30 of enclosure 10, near the right side (as viewed from the perspective in FIG. 1) of multipurpose tool pocket 14. Dashed fold lines 32 illustrate one example of where front flap 20 may be folded in order to overlap multipurpose tool pocket 14 and attach to outer surface 30 via portion 26 and portion 28.

Enclosure 10 may also include bit holders 34 positioned in bit pocket 16 and, more specifically, in bit holder cells 17 and 18. Bit holders 34 may be any suitable size, including approximately one-half an inch deep, and descriptions, indicia, or markings may be provided on the outer surfaces of bit holders 34 to identify which bits 36 should be placed in the openings within bit holders 34. Bit holders 34 may have openings for either 1, 2, 3, 4, 5, 6, 7, 8, 9, 10, or more bits. Further, bit holders 34 may be linked, or attached, to each other. Bit holders 34 may be made from any suitable plastic.

An exemplary set of bits 36 that may be used with one of the present tool kits follows: 4 slotted screwdriver bits, sizes ⅛ inches, 5⁄32 inches, 3⁄16 inches, and ¼ inches; 4 phillips screwdriver bits, sizes #0, #1, #2, and #3; 7 SAE hex key bits, sizes 1⁄16 inches, 3⁄32 inches, ⅛ inches, 5⁄32 inches, 3⁄16 inches, 7⁄32 inches, and ¼ inches; 7 metric hex key bits, sizes 2 millimeters (mm), 2.5 mm, 3 mm, 4 mm, 5 mm, 5.5 mm, and 6 mm; and 5 star bits (such as TORX brand bits), sizes #T8, #T9, #T10, #T15, and #T20 or 9 star bits.

Continuing, enclosure 10 may have adapter strap 40 configured to hold a bit drive adapter. Adapter strap 40 may be attached to inner surface 12 and, more specifically, to a portion of inner surface 12 that is disposed on front flap 20. Enclosure 10 may also have retaining strap 42 configured to hold a portion of wire and/or cable ties positioned within utility pocket 24. The present tool pockets and straps may be attached to the surfaces of enclosure 10 using any suitable means, such as by sewing, gluing, or the like.

Enclosure 10 may have multipurpose tool 50, termed a second multipurpose tool in some parts of this disclosure, in multipurpose tool pocket 14. A portion of a hook and loop fastner system 52 may be attached to an inner portion of top flap 22. A corresponding portion of the hook and loop fastner system 54 (shown, e.g., in FIG. 2), configured for mating with portion 52, may be attached to outer surface 30 of enclosure 10 and, more specifically, to a portion of outer surface 30 disposed on front flap 20. Dashed fold lines 56 illustrate one example of where top flap 22 may be folded in order to overlap and attach to front flap 20 via portions 52 and 54.

Figure 2:
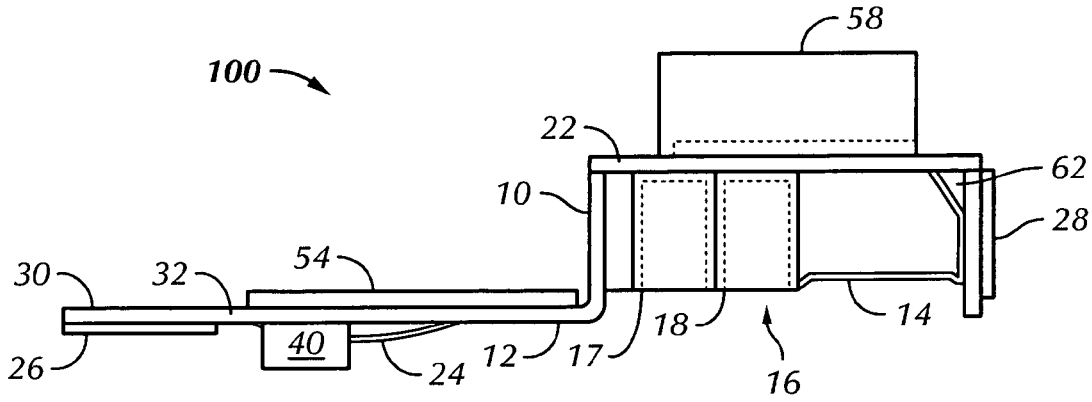
FIG. 2 is a top view of the arrangement shown in FIG. 1. The dashed lines represent certain hidden structure.
Figure 5:
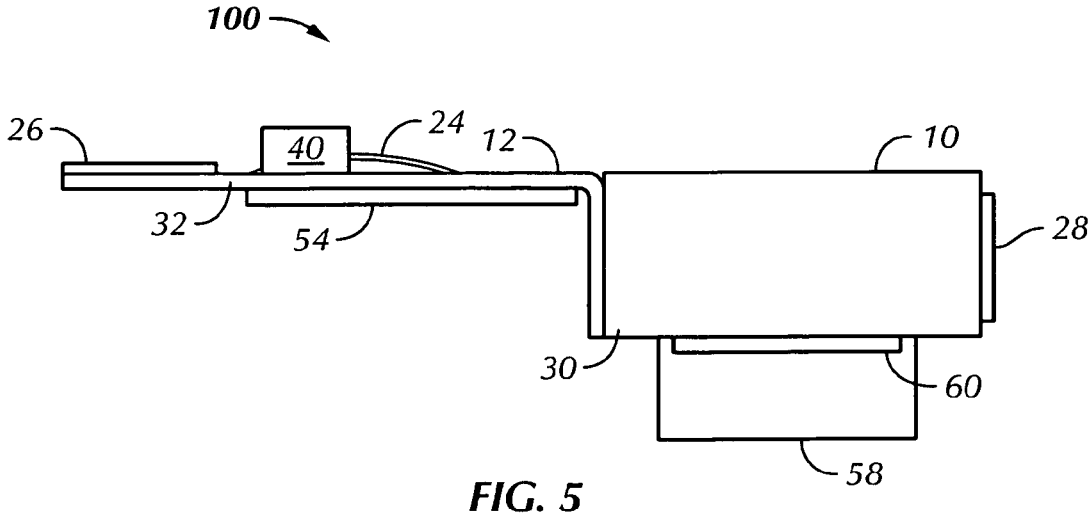
FIG. 5 is a bottom view of the arrangement shown in FIG. 1.
Figure 7:
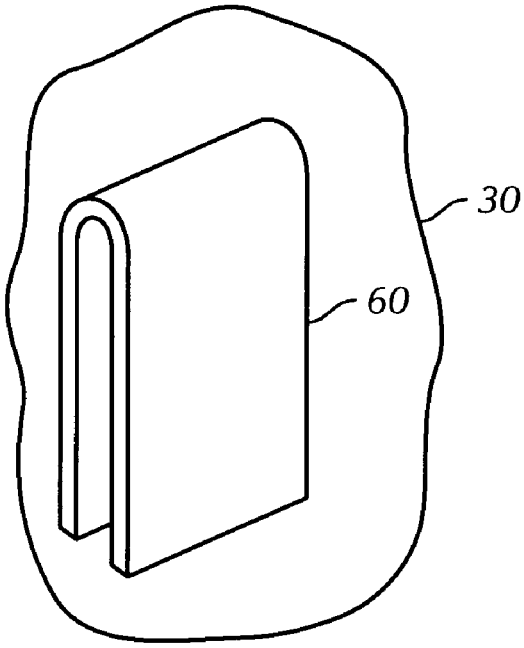
FIG. 7 shows an attachment structure in the form of a clip.
Figure 8:
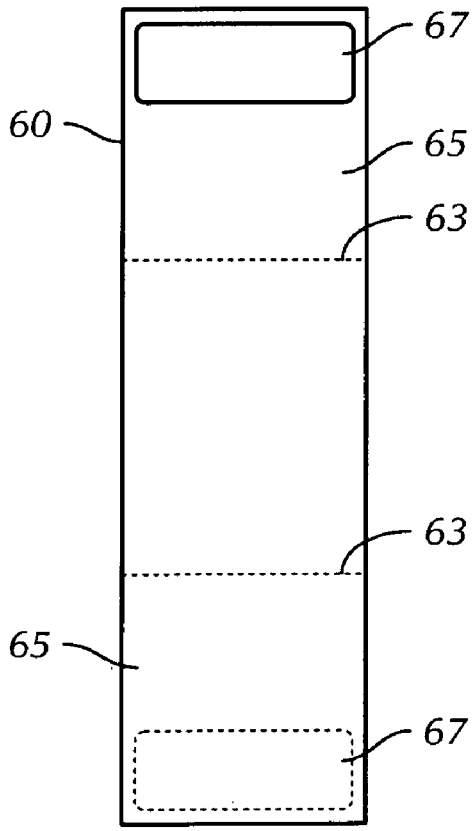
FIG. 8 shows an attachment structure having a strap portion and two strap creating portions.

FIGS. 2 and 5 are top and bottom views, respectively, of the arrangement shown in FIG. 1, and illustrates that top flap 22, and thus enclosure 10, may include compartment 58. Compartment 58 may be attached to enclosure 10; more specifically, compartment 58 may be attached to outer surface 30 of enclosure 10 using any suitable means, such as by sewing, gluing, or the like. Also shown is attachment structure 60 (hidden in FIG. 2 as shown by the dashed lines). Attachment structure 60 may take the form of a strap such that the strap may be threaded over an everyday belt and tool kit 100 may be worn at or near the waistline. Alternatively, attachment structure 60 may be a clip, as shown in FIG. 7, configured for attachment to any item with an edge, including an everyday belt. As still another alternative shown in FIG. 8, attachment structure 60 may include a strap portion 61 bordered by sewing lines 63 (which indicate where the attachment structure material can be sewn to the outer surface of the enclosure, not shown) and two strap creation portions 65, the top of which includes a portion of a hook and loop fastner system 67 on its inside and the bottom of which includes portion 67 on its outside. Strap creation portions 65 can be folded together over an existing belt of any kind to strap the enclosure to the belt without having to thread the belt through the created strap or strap portion 61. Attachment structure 60 may be attached to outer surface 30 of enclosure 10 using any suitable means, such as those disclosed above. Also shown in FIG. 2 is instruction pocket 62, which is configured to hold paper or other similar material that can include instructions or directions concerning the contents of, or how to use, tool kit 100.

Figure 3:
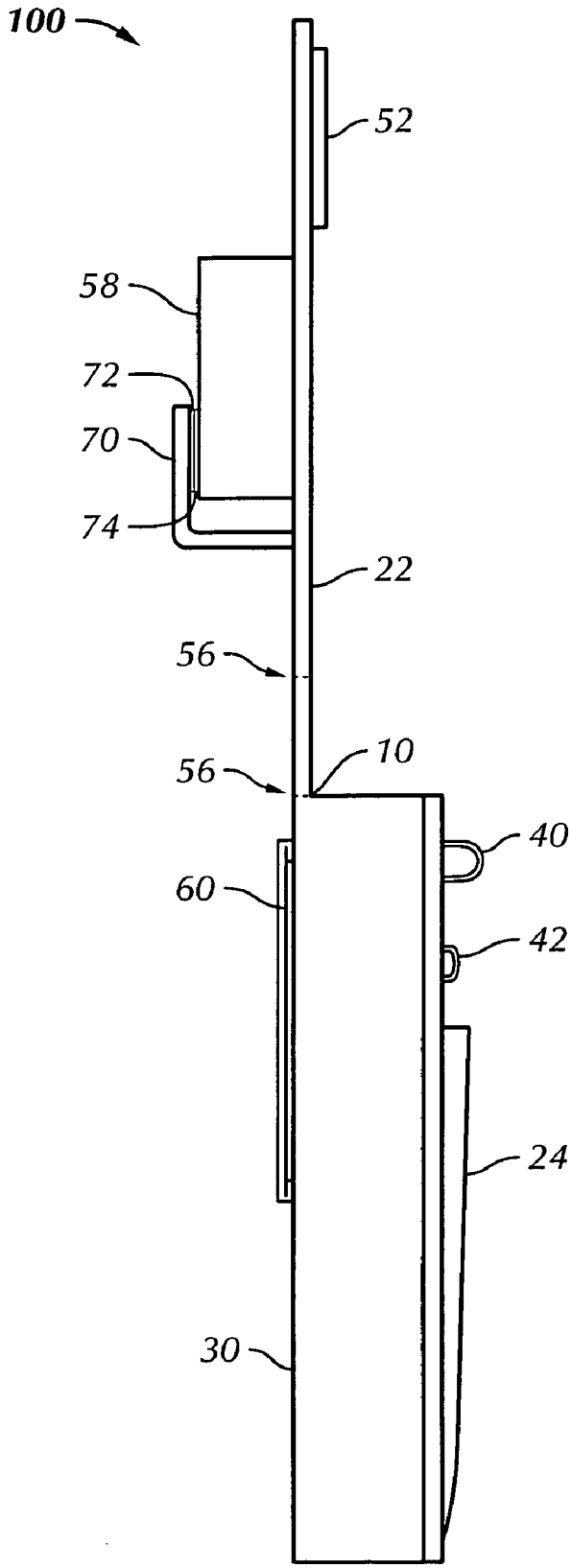
FIG. 3 is a left side view of the arrangement shown in FIG. 1.
Figure 4:
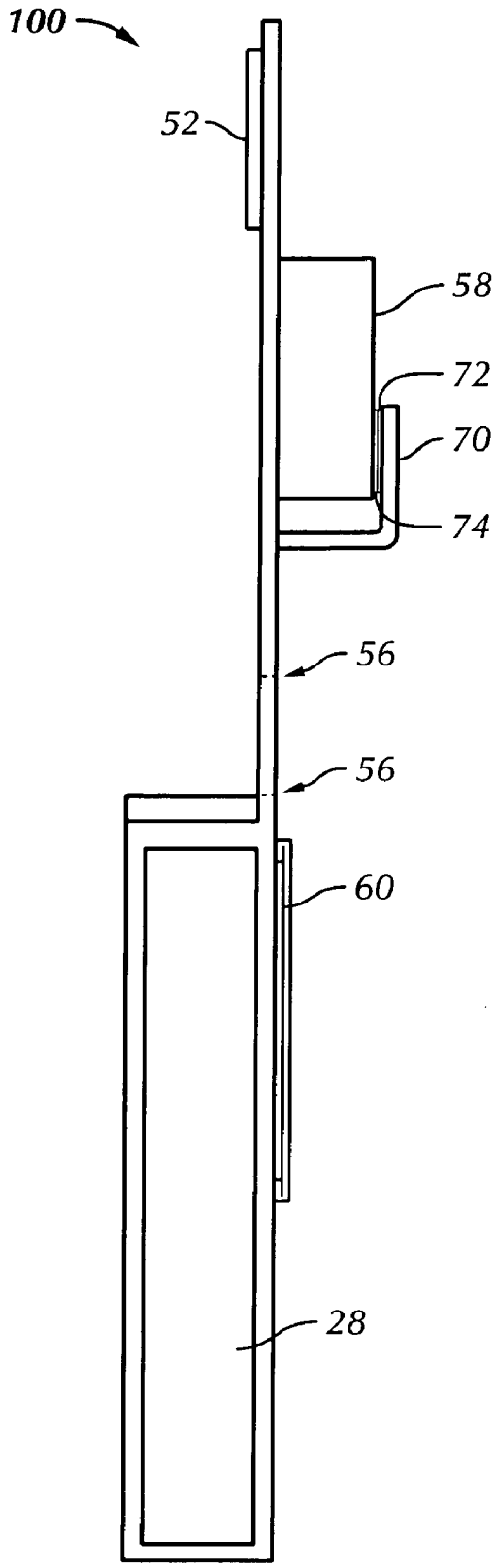
FIG. 4 is a right side view of the arrangement shown in FIG. 1.

FIGS. 3 and 4, which are left and right side views, respectively, of the arrangement shown in FIG. 1, show that compartment 58 may include a top flap 70 having an inner portion on which a portion of a hook and loop fastner system 72 is disposed, and an outer portion configured with a corresponding portion of the hook and loop fastner system 74 that mates with portion 72 when compartment 58 is closed.

Figure 6:
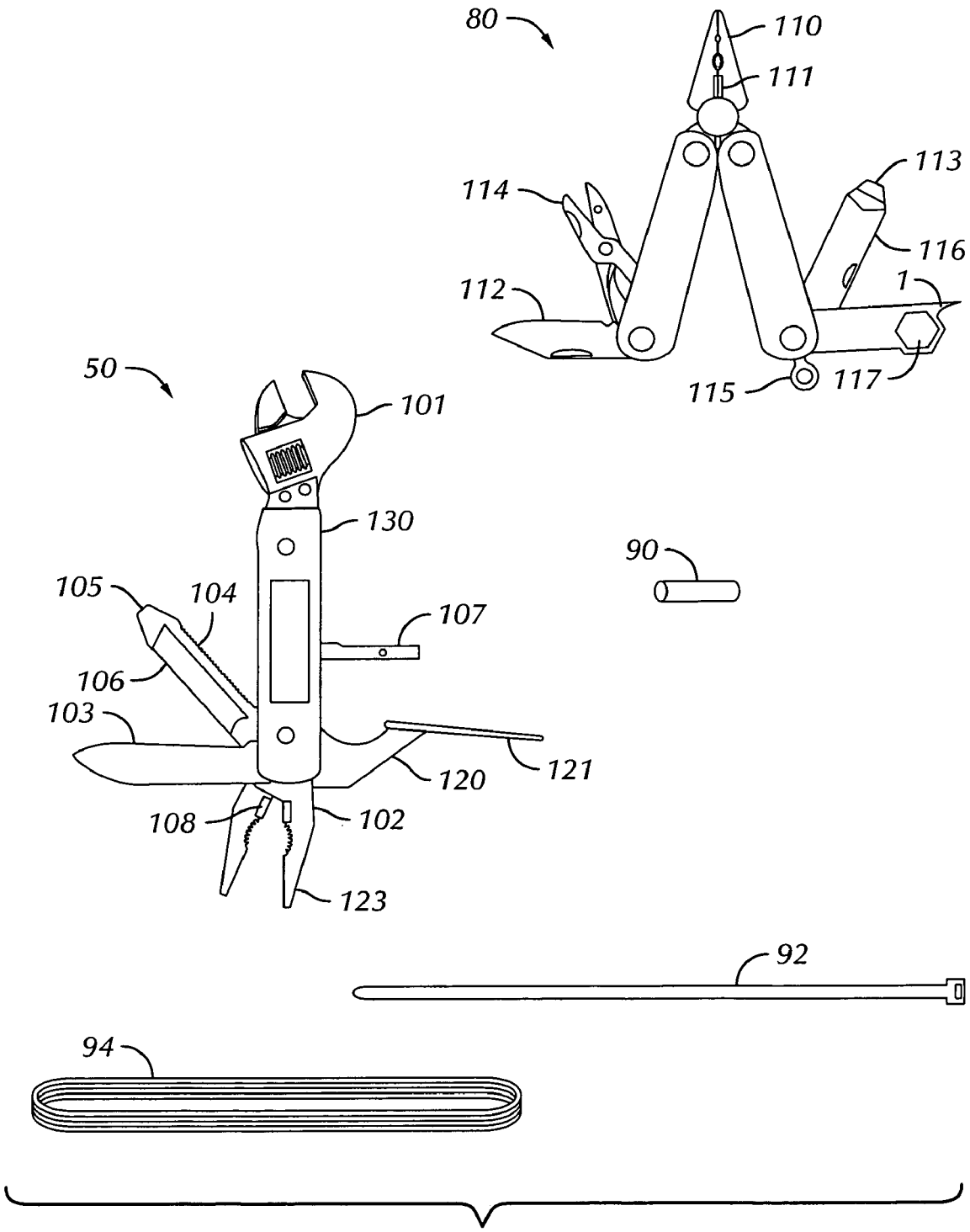
FIG. 6 shows one compilation of the multipurpose tools and other items that may be contained within the enclosure shown in FIG. 1.

FIG. 6 shows a compilation of the multipurpose tools and other items that may be contained within the enclosure shown in FIG. 1. As shown, multipurpose tool 50, which is configured to fit in multipurpose tool pocket 14, may include adjustable wrench (e.g., a crescent wrench) 101, pliers (e.g., needle nose pliers) 102, knife blade (e.g., a serrated or straight blade) 103, saw (e.g., wood saw) 104, screwdriver (e.g., slotted, or flathead, screwdriver) 105, file 106 (which, along with screwdriver 105, may be a part of the same piece of material as saw 104), bit driver 107, and a wire cutter and/or stripper 108 (which may be a part of the same material forming pliers 102). Bit drive adapter 90, which may be placed in adapter strap 40, may be configured to fit over bit driver 107 and further configured to accept bits 36. Bit driver 107 may have any suitable size, such as ⅜ inches. A multipurpose tools configured for use as multipurpose tool 50 is the ULTIMA-TOOL multipurpose tool, sold by Windzone of Austin, Tex. and which soon may be sold by Beza of Austin, Tex.

FIG. 6 also shows multipurpose tool 80, which may be referred to in this disclosure as a first multipurpose tool and is configured to fit in compartment 58. Multipurpose tool 80 may include pliers (e.g., needle nose pliers) 110, wire cutter and/or stripper 111 (which may be a part of the same material forming pliers 110), knife blade 112 (which may have a straight or serrated edge), a screwdriver (e.g., slotted, or flathead, screwdriver) 113, scissors 114, a ring (e.g., a lanyard ring) 115, a file 116 (which may be a part of the same piece of material as screwdriver 113), a wrench (e.g., a 10 mm wrench) 117, and a hole punch 118 (which may be a part of the same piece of material as wrench 117). A multipurpose tool configured for use as multipurpose tool 80 is the ESSENTI-TOOL multipurpose tool, sold by Windzone of Austin, Tex. and which soon may be sold by Beza of Austin, Tex.

The tools depicted and described in FIG. 6 may be made from any suitable material, such as metal, and more specifically such as stainless steel, titanium, nickel, or an alloy. The handles of first and second multipurpose tools 80 and 50, respectively, may be stainless steel, and may be constructed similarly to the handles of the PH801 multi-tool, available from Plenty Harvest Manufacturing Ltd., Flat C, 13/F., Ka Lee Building, No. 45, Ki Lung Street, Kowloon, Hong Kong.

FIG. 6 also shows cable tie 92, which is configured to be placed in utility pocket 24 and threaded, optionally, through retaining strap 42. One, two, three, four, five or more such cable ties may be placed within enclosure 10 in this fashion. The cable ties may have any suitable length, such as 7 inches. Also shown is wire 94 (e.g., mechanic's wire), which is also configured to be placed in utility pocket 24 and threaded, optionally, through retaining strap 42. Any suitable length of wire may be provided, such as approximately 30 inches. Either wire 94 or cable tie 92 may be used to lock pliers 102 in place by binding pliers arm 120 to body 130 of multipurpose tool 50. Arm 120 may include a flat handle segment 121 configured to contact nose portion 123 of pliers 102 as pliers 102 are retracted into the handle of multipurpose tool 50. Pliers 102 may be spring loaded.

The present tool kits are useful for many applications, including working on cars, motorcycles, boats, ATVs, airplanes, and vehicles of any kind. They are easy to carry—fitting easily in the palm of one hand in most embodiments—and can be attached to an everyday belt, placed in a pocket, or placed in a work belt, to name just a few ways of wearing them. Repairmen and women working with electric appliances; heating and ventilation systems; vehicles, and the like; or in the fields of roofing; general construction; electrical wiring installation; home repair or construction, and the like, could all benefit from using the present tool kits. If taking one a motorcycle ride, it may easily fit in the fork or saddle bag.

The different aspects of the disclosed devices may be utilized in various combinations and/or independently. Thus the present devices are not limited to only those combinations shown, but rather may include other combinations. Those of skill in the art will understand that numerous other modifications may be made to the disclosed devices, but all such similar substitutes and modifications are within the scope of the claims. For example, one version of the present tool kits may be configured to lack compartment 58 and, as a result, multipurpose tool 80.

I claim:

1. A tool kit comprising:

an enclosure having:

a multipurpose tool pocket;

a bit pocket;

an adapter strap;

a utility pocket configured to include at least cable ties and wire;

a front flap configured to fold in a side-to-side direction and overlap the multipurpose tool pocket and the bit pocket; and a top flap configured to fold in a top-to-bottom direction and overlap the front flap.

2. The tool kit of claim 1, further comprising a multipurpose tool in the multipurpose tool pocket.

3. The tool kit of claim 1, where the bit pocket comprises two bit holder cells.

4. The tool kit of claim 3, further comprising nine bit holders in the bit holder cells.

5. The tool kit of claim 4, where fewer than all of the nine bit holders are attached to each other.

6. The tool kit of claim 4, further comprising either three or four bits in each of the bit holders.

7. The tool kit of claim 6, further comprising slotted screwdriver bits, SAE hex key bits, metric hex key bits, and star bits.

8. The tool kit of claim 1, further comprising a multipurpose tool in the multipurpose tool pocket, the multipurpose tool including an adjustable wrench, pliers, a knife blade, a saw, a screwdriver, a file, a wire cutter and/or stripper, and a bit driver.

9. The tool kit of claim 1, further comprising a bit drive adapter held by the adapter strap.

10. The tool kit of claim 1, further comprising wire and cable ties in the utility pocket.

11. The tool kit of claim 1, where the front flap has an inner portion on which a first portion of a hook and loop fastener system is disposed, and where the enclosure has an outer portion configured with a second portion of the hook and loop fastener system that mates with the first portion on the inner portion of the front flap when the enclosure is closed.

12. The tool kit of claim 1, where the top flap has an inner portion on which a first portion of a hook and loop fastener system is disposed, and where the front flap has an outer portion configured with a second portion of the hook and loop fastener system that mates with the first portion on the inner portion of the top flap when the enclosure is closed.

13. The tool kit of claim 1, further comprising a compartment attached to an outer portion of the top flap.

14. The tool kit of claim 13, further comprising a multipurpose tool in the compartment.

15. The tool kit of claim 14, where the multipurpose tool includes pliers, a knife blade, a screwdriver, scissors, a file, a wire cutter and/or stripper, a wrench, a hole punch, a ring, and a bit driver.

16. The tool kit of claim 13, where the compartment includes a compartment top flap having an inner portion on which a first portion of a hook and loop fastener system is disposed; and an outer portion configured with a second portion of the hook and loop fastener system that mates with the first portion on the inner portion of the compartment top flap when the compartment is closed.

17. The tool kit of claim 1, where the enclosure is sized such that, when closed, it is approximately 2–3 inches wide, approximately 6–7 inches long, and approximately 1–2 inches deep.

18. A tool kit comprising:

an enclosure with an inner surface and an outer surface, the enclosure having:

a front flap;

a top flap configured to overlap the front flap;

a compartment attached to the top flap;

a first multipurpose tool in the compartment;

a second multipurpose tool pocket bordered by a first portion of the inner surface;

a second multipurpose tool in the second multipurpose tool pocket;

a bit pocket bordered by a second portion of the inner surface;

bit holders in the bit pocket, the bit holders containing bits;

a utility pocket attached to the inner surface, the utility pocket being configured to include at least cable ties and wire;

an adapter strap attached to the inner surface;

an attachment structure secured to the outer surface.

19. The tool kit of claim 18, where the attachment structure is a clip.

20. The tool kit of claim 18, where the attachment structure is a strap.

21. The tool kit of claim 18, where the enclosure is sized such that, when closed, it is approximately 2–3 inches wide, approximately 6–7 inches long, and approximately 1–2 inches deep.

22. The tool kit of claim 18, further comprising a bit drive adapter held by the adapter strap.

23. The tool kit of claim 18, where the compartment includes compartment top flap having an inner portion on which a first portion of a hook and loop fastener system is disposed; and an outer portion configured with a second portion of the hook and loop fastener system that mates with the first portion on the inner portion of the compartment top flap when the compartment is closed.

24. The tool kit of claim 18, where the top flap has an inner portion on which a first portion of a hook and loop fastener system is disposed, and where the front flap has an outer portion configured with a second portion of the hook and loop fastener system that mates with the first portion on the inner portion of the top flap when the enclosure is closed.

25. The tool kit of claim 18, where the front flap has an inner portion on which a second portion of a hook and loop fastener system is disposed, and where the enclosure has an outer portion configured with a second portion of the hook and loop fastener system that mates with the first portion on the inner portion of the front flap when the enclosure is closed.

26. The tool kit of claim 18, where the bit pocket comprises two bit holder cells, and where the bit holders are in the bit holder cells.

27. The tool kit of claim 26, further comprising nine bit holders in the bit holder cells.

28. The tool kit of claim 27, where fewer than all of the nine bit holders are attached to each other.

29. The tool kit of claim 27, further comprising either three or four bits in each of the bit holders.

30. The tool kit of claim 29, further comprising slotted screwdriver bits, SAE hex key bits, metric hex key bits, and star bits.

31. The tool kit of claim 18, where the second multipurpose tool includes an adjustable wrench, pliers, a knife blade, a saw, a screwdriver, a file, a wire cutter and/or stripper, and a bit driver.

32. The tool kit of claim 18, where the first multipurpose tool includes pliers, a knife blade, a screwdriver, scissors, a file, a wire cutter and/or stripper, a wrench, a hole punch, a ring, and a bit driver.

33. A tool kit comprising:

an enclosure having:

a multipurpose tool pocket;

a bit pocket extending from a back surface of the enclosure and being open in a direction that faces away from the back surface;

an adapter strap;

a utility pocket configured to include at least cable ties and wire;

a front flap configured to overlap the multipurpose tool pocket and the bit pocket; and a top flap configured to overlap the front flap.

34. The tool kit of claim 33, further comprising a multipurpose tool in the multipurpose tool pocket.

35. The tool kit of claim 33, where the bit pocket comprises two bit holder cells.

36. The tool kit of claim 35, further comprising nine bit holders in the bit holder cells.

37. The tool kit of claim 36, where fewer than all of the nine bit holders are attached to each other.

38. The tool kit of claim 36, further comprising either three or four bits in each of the bit holders.

39. The tool kit of claim 38, further comprising slotted screwdriver bits, SAE hex key bits, metric hex key bits, and star bits.

40. The tool kit of claim 33, further comprising a multipurpose tool in the multipurpose tool pocket, the multipurpose tool including an adjustable wrench, pliers, a knife blade, a saw, a screwdriver, a file, a wire cutter and/or stripper, and a bit driver.

41. The tool kit of claim 33, further comprising a bit drive adapter held by the adapter strap.

42. The tool kit of claim 33, further comprising wire and cable ties in the utility pocket.

43. The tool kit of claim 33, where the front flap has an inner portion on which a first portion of a hook and loop fastener system is disposed, and where the enclosure has an outer portion configured with a second portion of the hook and loop fastener system that mates with the first portion on the inner portion of the front flap when the enclosure is closed.

44. The tool kit of claim 33, where the top flap has an inner portion on which a first portion of a hook and loop fastener system is disposed, and where the front flap has an outer portion configured with a second portion of the hook and loop fastener system that mates with the first portion on the inner portion of the top flap when the enclosure is closed.

45. The tool kit of claim 33, further comprising a compartment attached to an outer portion of the top flap.

46. The tool kit of claim 45, further comprising a multipurpose tool in the compartment.

47. The tool kit of claim 46, where the multipurpose tool includes pliers, a knife blade, a screwdriver, scissors, a file, a wire cutter and/or stripper, a wrench, a hole punch, a ring, and a bit driver.

48. The tool kit of claim 45, where the compartment includes a compartment top flap having an inner portion on which a first portion of a hook and loop fastener system is disposed; and an outer portion configured with a second portion of the hook and loop fastener system that mates with the first portion on the inner portion of the compartment top flap when the compartment is closed.

49. The tool kit of claim 33, where the enclosure is sized such that, when closed, it is approximately 2–3 inches wide, approximately 6–7 inches long, and approximately 1–2 inches deep.

* * * * *